US006865917B2

(12) United States Patent
Golovashchenko et al.

(10) Patent No.: US 6,865,917 B2
(45) Date of Patent: Mar. 15, 2005

(54) FLANGING AND HEMMING PROCESS WITH RADIAL COMPRESSION OF THE BLANK STRETCHED SURFACE

(75) Inventors: Sergey Fedorovich Golovashchenko, Beverly Hills, MI (US); Sergey Sergeyevich Kolesov, Dearborn, MI (US); Andrei Viktorovich Vlassov, Moscow (RU); Laurent Bernard Chappuis, Grosse Pointe Park, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/249,277

(22) Filed: Mar. 27, 2003

(65) Prior Publication Data

US 2004/0187535 A1 Sep. 30, 2004

(51) Int. Cl.[7] ..... B21D 22/10; B21D 27/10
(52) U.S. Cl. ..... 72/57; 72/465.1; 72/466.8
(58) Field of Search ..... 72/54, 57, 58, 72/60, 465.1, 466.8

(56) References Cited

U.S. PATENT DOCUMENTS

| | | | | |
|---|---|---|---|---|
| 3,276,239 A | | 10/1966 | Achler et al. | |
| 3,353,397 A | | 11/1967 | Hoffmann | |
| 3,702,558 A | | 11/1972 | Swenson et al. | |
| 3,760,622 A | | 9/1973 | Mansell | |
| 3,978,706 A | | 9/1976 | Nakagawa et al. | |
| 3,986,379 A | | 10/1976 | Mansell | |
| 4,282,735 A | * | 8/1981 | Break | 72/465.1 |
| 4,446,711 A | | 5/1984 | Valente | |
| 4,494,393 A | | 1/1985 | Bruce | |
| 4,509,358 A | | 4/1985 | Krowl | |
| 4,643,016 A | * | 2/1987 | Barberine et al. | 72/465.1 |
| 5,205,146 A | * | 4/1993 | Wilkins et al. | 72/57 |
| 5,214,951 A | | 6/1993 | Waddell | |
| 5,454,261 A | | 10/1995 | Campian | |
| 5,490,407 A | * | 2/1996 | Doose | 72/57 |
| 5,603,236 A | | 2/1997 | Hongo | |
| 5,948,185 A | | 9/1999 | Krajewski et al. | |
| 5,953,951 A | | 9/1999 | Fujimoto et al. | |
| 5,970,769 A | | 10/1999 | Lipari | |
| 6,029,334 A | | 2/2000 | Hartley | |
| 6,029,486 A | * | 2/2000 | Haraga et al. | 72/57 |
| 6,052,887 A | * | 4/2000 | Dziadosz | 72/57 |

OTHER PUBLICATIONS

David A. Smith, Die Design Handbook, Third Edition, pp. 14–1–14–22.

M. Yajima et al., The Effects of Hydrostatic Pressure on the Ductility of Metals and Alloys. Int. Journ. of Fracture Mech., 6 (1970) pp. 139–150.

P. W. Bridgman, Studies in Large Plastic Flow and Fracture, Harvard University Press, Cambridge, MA 1964, pp. 48–73.

* cited by examiner

*Primary Examiner*—David Jones
(74) *Attorney, Agent, or Firm*—Raymond L. Coppiellie

(57) ABSTRACT

A method and tool for forming a hem flange pre-hem and a final hem on a sheet metal panel wherein elastomeric tooling elements are used to apply radial compression during a forming operation. The elastomeric tooling elements are compressed and apply pressure to a side of the sheet metal panel, for example an aluminum panel, that is stretched during a forming process step. A foil layer may be placed between the sheet metal blank and the elastomeric tooling element to reduce friction and further improve forming performance.

9 Claims, 2 Drawing Sheets

FLANGING AND HEMMING PROCESS WITH RADIAL COMPRESSION OF THE BLANK STRETCHED SURFACE

BACKGROUND OF INVENTION

1. Field of the Invention

The present invention relates to a tool for forming a hem that may be used to secure two sheet metal panels together.

2. Background Art

Vehicle body panels such as deck lids, hoods, doors, and the like frequently include inner and outer panels that are secured together by means of a hem flange that extends about their periphery. Such body panels have traditionally been manufactured from steel sheet metal panels. Steel is very ductile and is easily formed in a hem forming operation. However, automotive manufacturers are increasingly turning to aluminum to obtain weight savings for vehicle body panels.

Aluminum alloys offer a high strength/low weight alternative to steel. Aluminum does not, however, have the same level of ductility. Forming a hem on a body panel made of aluminum sheet metal is more difficult than forming the same hem with steel sheet metal due to aluminum's reduced ductility compared to steel. An early solution to this problem was to form larger radius hems when working with aluminum sheet metal. Larger radius hems result in lower fit and finish ratings because larger radius hems make gaps appear larger between door closure panels and their openings. Further, the tendency of aluminum to tear or split at the radius of the hem caused by work hardening results in high part rejection rates and unacceptable scrap rates.

These and other problems relating to forming a hem flange and hem with aluminum sheet metal panels are addressed by applicants' invention.

SUMMARY OF INVENTION

According to one aspect of the present invention, a tool for forming a sheet metal article is provided that comprises a first die, a second die, and an elastomeric tool element engaging one side of the sheet metal blank. The first die defines a surface over which a sheet metal blank is to be formed. The second die is movable away from and into engagement with the first die. The elastomeric tool element engages a side of the sheet metal blank opposite the surface over which the sheet metal blank is to be formed so that the elastomeric tool element applies radial compression to the sheet metal blank as it is formed over the surface, thereby improving the formability of the sheet metal blank as it is formed.

According to another aspect of the invention, the tool may be a flanging die used to form an outer edge of a sheet metal blank to a generally perpendicular orientation relative to the adjacent tool elements of the sheet metal blank. The second die retains the elastomeric tool element for movement relative to the first die. The surface of the first die over which the sheet metal blank is to be formed preferably defines a substantially right angle surface. In addition, a layer of foil may be placed between the elastomeric tool element retained by the second die and the sheet metal blank as the elastomeric tool element of the flanging die forms the outer edge of the sheet metal blank.

According to another aspect of the invention, the tool may be a pre-hemming die used to form a flange that was previously formed to a generally perpendicular orientation relative to the adjacent portions of the sheet metal blank. The first die defines an acutely angled surface. The elastomeric tool element of the pre-hemming die forms the flange against the acutely angled surface to form a pre-hem flange that is acutely angled relative to the adjacent portion of the sheet metal blank.

According to yet another aspect of the invention, the tool may be a final hemming die used to hem a previously formed pre-hem flange over a peripheral flange of an inner panel. The inner panel is placed on the sheet metal blank with the peripheral flange of an inner panel. The inner panel is placed on the sheet metal blank with the peripheral flange near the pre-hem flange of the sheet metal blank. The elastomeric tool element of the final hemming die forms the pre-hem flange over the peripheral flange of the inner panel to hem the sheet metal blank to the inner panel.

According to other aspects of the invention, the elastomeric tool element may have first and second portions having a different degree of hardness. The elastomeric tool element exerts a radial compression force on a side of the sheet metal blank that is under tensile stress while the blank is formed, that is, the exterior side of a bend radius.

Another aspect of the invention relates to a method of forming a hem flange for securing a sheet metal outer panel to an inner panel. The method comprises forming a hem flange with a flanging die to form an outer edge of a sheet metal blank to a generally perpendicular orientation relative to the adjacent portions of the sheet metal blank. The flanging die has a first elastomeric tool element that engages the sheet metal outer panel and forces it into engagement with a surface over which the sheet metal blank is formed to form the hem flange. The hem flange is formed to a generally perpendicular orientation relative to the adjacent portions of the sheet metal blank. Next, a pre-hem flange is formed with a pre-hemming die to form the outer edge of the sheet metal panel that had been previously formed to a generally perpendicular orientation relative to the adjacent portions of the sheet metal blank. The pre-hemming die has a second elastomeric tool element that forms the flange against the acutely angled surface to form the pre-hem flange into an acutely angled orientation relative to the adjacent portions of the sheet metal blank. An inner panel is placed upon the sheet metal blank with a peripheral flange near the pre-hem flange of the sheet metal blank. A hem is formed with a final hemming die that forms the pre-hem flange with a third elastomeric tool element that engages the pre-hem flange to form the pre-hem flange over the peripheral flange of the inner panel thereby hemming the sheet metal blank to the inner panel.

According to another aspect of the invention, the method may comprise placing a layer of foil between the elastomeric insert and the flanging die as the hem flange is formed.

These and other aspects of the invention will be better understood in view of the attached drawings and following detailed description of preferred modes of practicing the invention.

DETAILED DESCRIPTION

Figure 1:
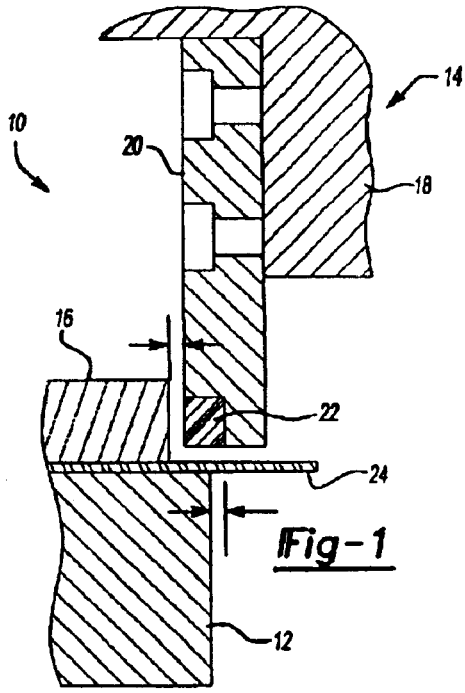
FIG. 1 is a schematic cross-sectional view of a flanging tool with a sheet metal blank prior to formation of a flange on the blank.

Referring now to FIG. 1, a flanging tool 10 is shown to include a lower die 12 and an upper die generally indicated by reference numeral 14. The upper die 14 includes a clamping element 16 and a ram 18. A flanging block 20 is secured to the ram 18 and includes an elastomeric insert 22. The elastomeric insert 22 in FIG. 1 is shown prior to engaging a sheet metal blank 24 that is held against the lower die 12 by means of a clamping element 16.

The drawings indicate tools that are used to form a single flange but it should be understood that in many instances hemming tools are designed to engage the entire periphery of a panel such as a door, hood, decklid, roof, or other part of a vehicle or other structure that includes an inner and outer panel that are connected together by means of a hem flange. While only one flange is shown in the attached drawings, it should be understood that the invention is applicable to other types of hemming operations wherein a plurality of hems are formed on the same panel.

Figure 2:
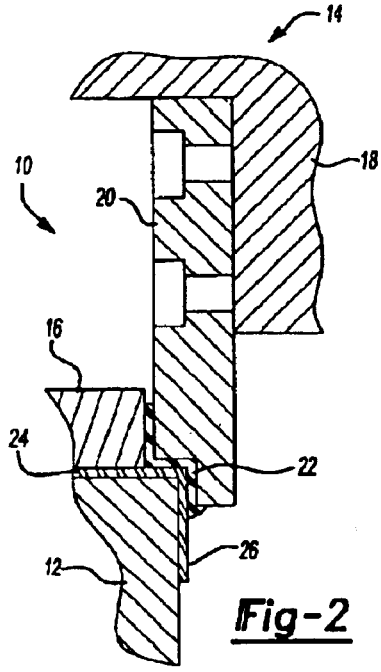
FIG. 2 is a cross-sectional view of a flanging tool after forming a flange on the blank.

Referring now to FIG. 2, the flanging tool 10 is shown with the upper die 14 moved into full engagement with the lower die 12. The sheet metal blank 24 is held in place by the clamping element 16 while the elastomeric insert 22 is moved by the ram and flanging block 20 to form the sheet metal blank 24 to include a flange 26.

Figure 3:
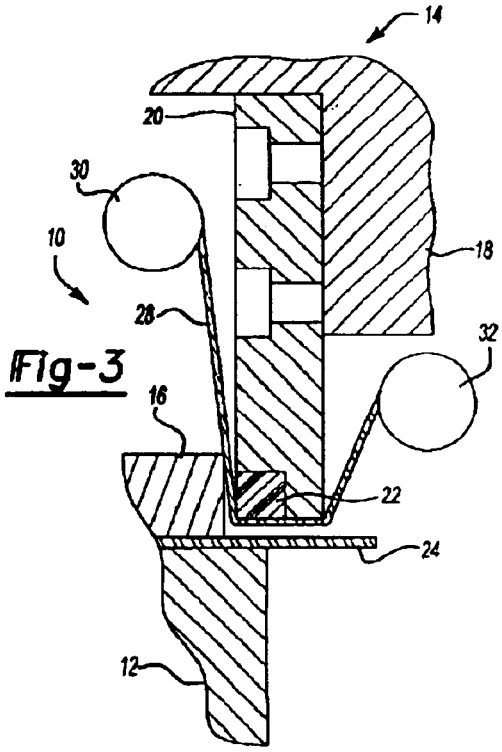
FIG. 3 is a cross-sectional view of a flanging tool similar to that shown in FIG. 1 also including a foil web supply system.

Alternatively, as shown in FIG. 3, the flanging tool 10 may also include a foil web 28 that is automatically advanced from a supply roll 30 to a take-up roll 32. The foil web 28 is held between the elastomeric insert 22 and the sheet metal blank 24 during the flanging process to reduce friction and further improve the ability of a flange 26 to be formed on the sheet metal blank 24.

Figure 4:
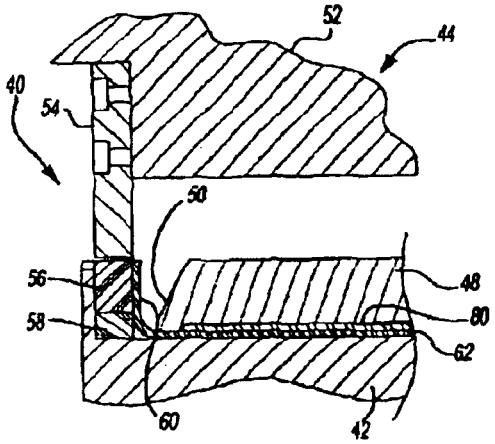
FIG. 4 is a cross-sectional view of a pre-hem tool just prior to forming a pre-hemming bend on a sheet metal blank having a flange.
Figure 5:
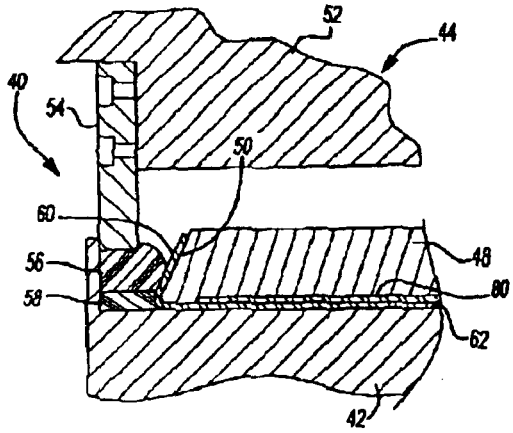
FIG. 5 is a cross-sectional view of a pre-hem tool after forming a pre-hem bend on the sheet metal blank.

Referring now to FIGS. 4 and 5, a pre-hem tool 40 is shown to include a lower die 42 and an upper die generally referred to by reference numeral 44. The upper die 44 includes a clamping pre-hem anvil 48. Pre-hem anvil 48 includes a pre-hem surface 50 against which the flange 26 is to be formed. The upper die 44 includes a pre-hem ram 52 that supports a pre-hem insert 54. Pre-hem insert 54 is adapted to engage a low modulus elastomeric insert 56 and indirectly engage a high modulus elastomeric insert 58 that are compressed by the pre-hem insert 54 as the pre-hem ram 52 is moved toward lower die 42. The flange 26 formed by the flanging tool 10 is pressed by the inserts 56, 58 against the pre-hem surface 50 to form a pre-hem flange 60. The flange 60 is part of a sheet metal blank 62 that includes a pre-hem flange.

Figure 6:
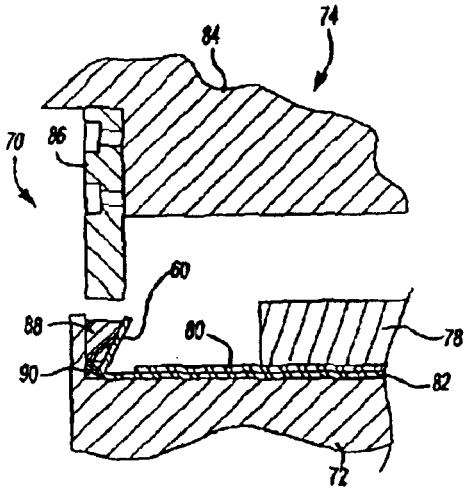
FIG. 6 is a cross-sectional view of a hem tool just prior to forming a hem on a sheet metal blank having a pre-hem bend.
Figure 7:
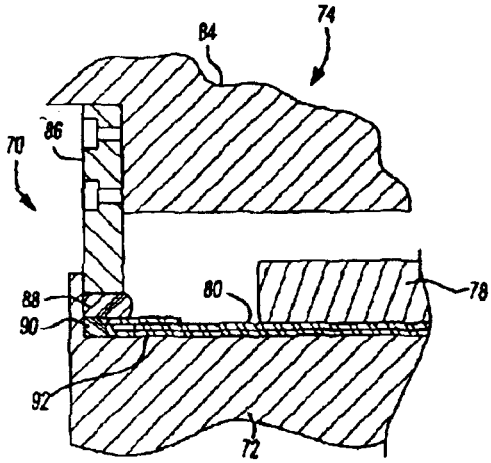
FIG. 7 is a cross-sectional view of a hem tool showing the hemmed panel with the sheet metal blank secured to an inner panel.

Referring now to FIGS. 6 and 7, a hem tool 70 is shown to include a lower die 72 and an upper die generally indicated by reference numeral 74. The upper die includes a clamp spacer 78 that engages an inner panel 80 and holds it in place on the pre-hem panel 82 in the lower die 72. The upper die 74 includes a hem ram 84 that retains a hem insert 86. Hem insert 86 is moved by the hem ram 84 into engagement with a low modulus elastomeric tool element 88 and a high modulus elastomeric tool element 90. The elastomeric tool elements 88 and 90 engage the flange 60 formed by the pre-hem tool 40 when the hem insert 86 compresses the elastomeric tool elements 88 and 90. The elastomeric tool elements are compressed as they act upon the pre-hem flange 60 to cause it to fold downwardly and engage the inner panel 80 to form a hemmed panel 92.

While the best mode for carrying out the invention has been described in detail, those familiar with the art to which this invention relates will recognize various alternative designs and embodiments for practicing the invention as defined by the following claims.

What is claimed is:

1. A tool for forming a sheet metal article, comprising:

a first die defining a surface over which a sheet metal blank is to be formed;

a second die being moveable away from and into engagement with the first die;

an elastomeric tool element engaging a side of the sheet metal blank opposite the surface over which the sheet metal blank is to be formed, the elastomeric tool element applying pressure to the sheet metal blank as it is formed over the surface to improve the formability of the sheet metal blank as it is formed; and wherein a layer of foil is placed between the elastomeric tool element of a flanging die and the sheet metal blank as the elastomeric tool element of the flanging die forms an outer edge of the sheet metal blank.

2. The tool of claim 1 wherein the flanging die is used to form the outer edge of a sheet metal blank to a generally perpendicular orientation relative to the adjacent tool elements of the sheet metal blank, the second die retaining the elastomeric tool element for movement relative to the first die, and wherein the surface of the first die over which the sheet metal blank is to be formed defines a right angle surface.

3. The tool of claim 1 wherein the tool is a pre-hemming die used to form a flange that was previously formed to a generally perpendicular orientation relative to the adjacent portions of the sheet metal blank, the first die defining an acutely angled surface, and wherein the elastomeric tool element of the pre-hemming die forms the flange against the acutely angled surface to form a pre-hem flange that is acutely angled relative to the adjacent portion of the sheet metal blank.

4. The tool of claim 1 wherein the tool is a final hemming die used to form a pre-hem flange that was previously formed to an acutely angled orientation relative to the adjacent portions of the sheet metal blank, the first die defining a surface on which the sheet metal blank having a pre-hem flange formed thereon, an inner panel being placed upon the sheet metal blank with a peripheral flange proximate the pre-hem flange of the sheet metal blank, and wherein the elastomeric tool element of the final hemming die forms the pre-hem flange over the peripheral flange of the inner panel thereby hemming the sheet metal blank to the inner panel.

5. The tool of claim 1 wherein the elastomeric tool element has a first portion having a first degree of hardness and a second portion having a second degree of hardness.

6. The tool of claim 1 wherein the force exerted by the elastomeric tool element is exerted on a side of the sheet metal blank that is under tensile stress when the blank is formed that is the exterior side of a bend radius.

7. A method of forming a hem flange to secure a sheet metal outer panel to an inner panel, comprising:

forming a hem flange with a flanging die to form an outer edge of a sheet metal blank to a generally perpendicular orientation relative to the adjacent portions of the sheet metal blank, the flanging die having a first elastomeric tool element that engages the sheet metal outer panel and forces it into engagement with a surface over which the sheet metal blank is to be formed to form the hem flange to a generally perpendicular orientation relative to the adjacent portions of the sheet metal blank;

forming a pre-hem flange with a pre-hemming die to form the outer edge of the sheet metal panel that was previously formed to a generally perpendicular orientation relative to the adjacent portions of the sheet metal blank, the pre-hemming die having a second elastomeric tool element that forms the flange against an acutely angled surface to form the pre-hem flange in an acutely angled orientation relative to the adjacent portion of the sheet metal blank;

placing an inner panel upon the sheet metal blank with a peripheral flange proximate the pre-hem flange of the sheet metal blank; and forming a hem with a final hemming die to form the pre-hem flange that was previously formed to an acutely angled orientation relative to the adjacent portions of the sheet metal blank, the final hemming die having a third elastomeric tool element that engages the pre-hem flange to form the pre-hem flange over the peripheral flange of the inner panel thereby hemming the sheet metal blank to the inner panel.

8. The method of claim 7 further comprising placing a layer of foil between the first elastomeric tool element of the flanging die and the sheet metal blank as the hem flange is formed.

9. A tool for forming a sheet metal article, comprising:

a first die defining a surface over which a sheet metal blank is to be formed;

a second die being moveable away from and into engagement with the first die;

an elastomeric tool element engaging a side of the sheet metal blank opposite the surface over which the sheet metal blank is to be formed, the elastomeric tool element applying pressure to the sheet metal blank as it is formed over the surface to improve the formability of the sheet metal blank as it is formed; and wherein the elastomeric tool element has a first portion having a first degree of hardness and a second portion having a second degree of hardness.

* * * * *